US009815530B2

(12) United States Patent
Fusy

(10) Patent No.: US 9,815,530 B2
(45) Date of Patent: Nov. 14, 2017

(54) SHIP TO SHORE OR SHIP TO SHIP FLUID PRODUCT TRANSFER ARM

(71) Applicant: FMC Technologies SA, Sens (FR)

(72) Inventor: Joël Fusy, Vincelles (FR)

(73) Assignee: FMC Technologies SA, Sens (FR)

( * ) Notice: Subject to any disclaimer, the term of this patent is extended or adjusted under 35 U.S.C. 154(b) by 29 days.

(21) Appl. No.: 14/781,292

(22) PCT Filed: Mar. 28, 2014

(86) PCT No.: PCT/IB2014/060274
§ 371 (c)(1),
(2) Date: Sep. 29, 2015

(87) PCT Pub. No.: WO2014/155358
PCT Pub. Date: Oct. 2, 2014

(65) Prior Publication Data

US 2016/0304168 A1 Oct. 20, 2016

(30) Foreign Application Priority Data

Mar. 29, 2013 (FR) ..... 13 52949

(51) Int. Cl.
*B63B 27/24* (2006.01)
*B67D 9/02* (2010.01)
*B63B 27/34* (2006.01)

(52) U.S. Cl.
CPC ..... *B63B 27/24* (2013.01); *B63B 27/34* (2013.01); *B67D 9/02* (2013.01); *Y10T 137/8807* (2015.04)

(58) Field of Classification Search
CPC ..... B63B 27/24; B63B 27/34; B67D 9/02; Y10T 137/8807
USPC ..... 137/615
See application file for complete search history.

(56) References Cited

U.S. PATENT DOCUMENTS

| | | | | |
|---|---|---|---|---|
| 1,478,925 A | | 12/1923 | Steed | |
| 3,021,867 A | | 2/1962 | Gallagher | |
| 3,889,728 A | | 6/1975 | Riche | |
| 4,093,003 A | * | 6/1978 | Miller et al. | B67D 9/02 137/615 |

(Continued)

FOREIGN PATENT DOCUMENTS

| | | |
|---|---|---|
| DE | 1 264 342 | 3/1968 |
| DE | 88 09 509.6 U1 | 1/1989 |

(Continued)

*Primary Examiner* — Kevin Lee

(57) ABSTRACT

A transfer arm for a fluid product includes a transfer pipe having sections linked by fluid-tight articulations and an end provided with a device for connecting the pipe to a target duct. A support structure for the pipe has an inner branch mounted on a base and an outer branch suspended from the inner branch by an articulation assembly. The articulation assembly enables rotation of the outer branch around vertical and horizontal axes and is positioned between first and second ends of the outer branch. The first end is provided with a counterweight for balancing parts of the outer branch that are situated on opposite sides of the horizontal rotational axis. The arm also has a disengageable device for actuating the rotations of the outer branch around the horizontal and vertical axes and a flexible link which suspends the pipe, upstream of the device, from the second end of the outer branch.

17 Claims, 3 Drawing Sheets

(56) References Cited

U.S. PATENT DOCUMENTS

| | | | | |
|---|---|---|---|---|
| 4,290,463 | A * | 9/1981 | DeGeorge et al. | B67D 9/02 137/615 |
| 7,610,934 | B2 * | 11/2009 | Naciri et al. | B63B 27/24 137/615 |
| 8,176,938 | B2 * | 5/2012 | Queau et al. | B63B 27/24 137/342 |

FOREIGN PATENT DOCUMENTS

| | | | |
|---|---|---|---|
| WO | WO 2004/099062 | A1 | 11/2004 |
| WO | WO 2007/113203 | A1 | 10/2007 |

* cited by examiner

SHIP TO SHORE OR SHIP TO SHIP FLUID PRODUCT TRANSFER ARM

BACKGROUND OF THE INVENTION

The invention relates to a transfer arm for a fluid product, and for example particularly for petroleum products.

More particularly it concerns a loading arm dedicated to an application of transfer to a ship, whether it be from a fixed installation or a floating installation, for supplying a multitude of types of ships, from a ferry to a container ship, etc., with petroleum products or liquefied petroleum gas (LPG) or liquefied natural gas (LNG), which serves as fuel for the machinery of those ships, in particular for environmental reasons regarding the loading of LNG.

This type of supply operation is known in the industry as "bunkering" or "fuelling".

Generally, when installed at the center of a supply ship, such an arm may be connected to boats moored on the port or starboard side.

Such a loading arm is for example described in the patent application FR-2 181 584.

SUMMARY OF THE INVENTION

The invention is directed to providing a transfer arm of the same kind, but with improved performance to meet the requirements of transferring multi-products and/or liquid phase and gaseous return phase and of the multiple connections situated in confined spaces.

To that end it provides a transfer arm comprising one or more transfer pipes having several sections linked to each other by fluid-tight articulations and having an end provided with a connect-disconnect device adapted for the connection of the pipe to a target duct, and further comprising a support structure for the pipe or pipes comprising an inner branch which is mounted on a base and an outer branch, characterized in that the outer branch is suspended from the inner branch by articulation means enabling rotation of the outer branch around a vertical axis and around a horizontal axis. The outer branch is provided with an end equipped with a balancing counterweight for balancing that branch and the outer pipe or pipes associated with it, around the horizontal rotational axis defined by the articulation means, and the arm comprises disengageable actuating means for actuating the rotations of the outer branch around the horizontal axis and around the vertical axis and one or more flexible links which suspend the transfer pipe or pipes, upstream of the connect-disconnect device, from the outer branch.

The present invention thus makes it possible in particular to have a certain degree of flexibility in the join between the pipe and the support structure, which is advantageous not only during the operation of connection to the target duct but also after the connection in following the movements of the ship to which the pipe is connected, in order to avoid arresting the movement of the connections and avoid overloading them.

According to a particular provision, the main pipe is adapted for transferring product and particularly liquefied natural gas and the arm may comprise a second pipe, for another product or even for the return of gas vapors, which is also in sections linked by fluid-tight articulations, provided with a connect-disconnect device adapted for the connection of the second pipe to a second target duct, and suspended by a second flexible link, upstream of its connect-disconnect device, from the outer branch of the support structure.

Such provisions in particular have the advantage of being able to connect the two pipes in two phases.

According to other features which may be combined:

- the outer branch has, in a T-shaped general configuration, two lateral ends for the attachment of the flexible link or links to that branch,
- each flexible link is a cable, a chain, or a cord,
- the inner branch is rotatably mounted on the base, around a horizontal axis, between a first end provided with a counterweight and a second end, from which the outer branch is suspended from that inner branch, by means enabling the articulation of that outer branch relative to the inner branch to turn around a horizontal axis extending in parallel to the horizontal rotational axis of the inner branch,
- the arm comprises a device of pantograph type mounted on the inner branch, for keeping vertical the vertical rotational axis of the outer branch,
- the inner branch is rotatably mounted on the base, around a vertical axis,
- the arm comprises actuating means for actuating the rotation or rotations of the inner branch on the base,
- the articulation means comprise a clevis articulation defining the horizontal rotational axis and which is rotatably mounted on a support, about the vertical rotational axis of the outer branch, via a slewing ring.
- the support is a bracket-shaped part on one of the branches of which is articulated the clevis articulation,
- the other branch of the bracket is articulated to the inner branch, around said horizontal axis extending parallel to the horizontal rotational axis of the inner branch, via a slewing ring,
- the inner branch is mounted on the base via a bracket-shaped support,
- the actuating means comprise at least one jack or a motor.
- the means for actuating the rotation of the inner branch around the vertical axis comprise jacks acting on the inner branch via a cable and a set of pulleys, or direct engagement actuation by jack or motor,
- the fluid-tight articulations each take the form of an assembly, formed by the joining of at least one bend and at least one swivel joint, and of which there is a number per pipe and which are configured with the sections of the pipe or pipes so as to give that pipe six degrees of freedom,
- the arm is equipped with one or more pipes for products adapted for transferring the same or different products while enabling them to be connected independently to the connections dedicated to those products in the same transfer phase.

Other features and advantages of the present invention will emerge more clearly from the following description, which is made with reference to the accompanying drawings, in which:

BRIEF DESCRIPTION OF THE DRAWINGS

In these drawings, the same references designate the same parts and the scales are not in all cases the same from one Figure to another.

DETAILED DESCRIPTION OF THE INVENTION

Referring in particular to FIGS. 1 to 4, the transfer arm 1 comprises two fluid transfer pipes 2, 3 and further comprises a support structure 4 for those pipes 2, 3.

Figure 5:
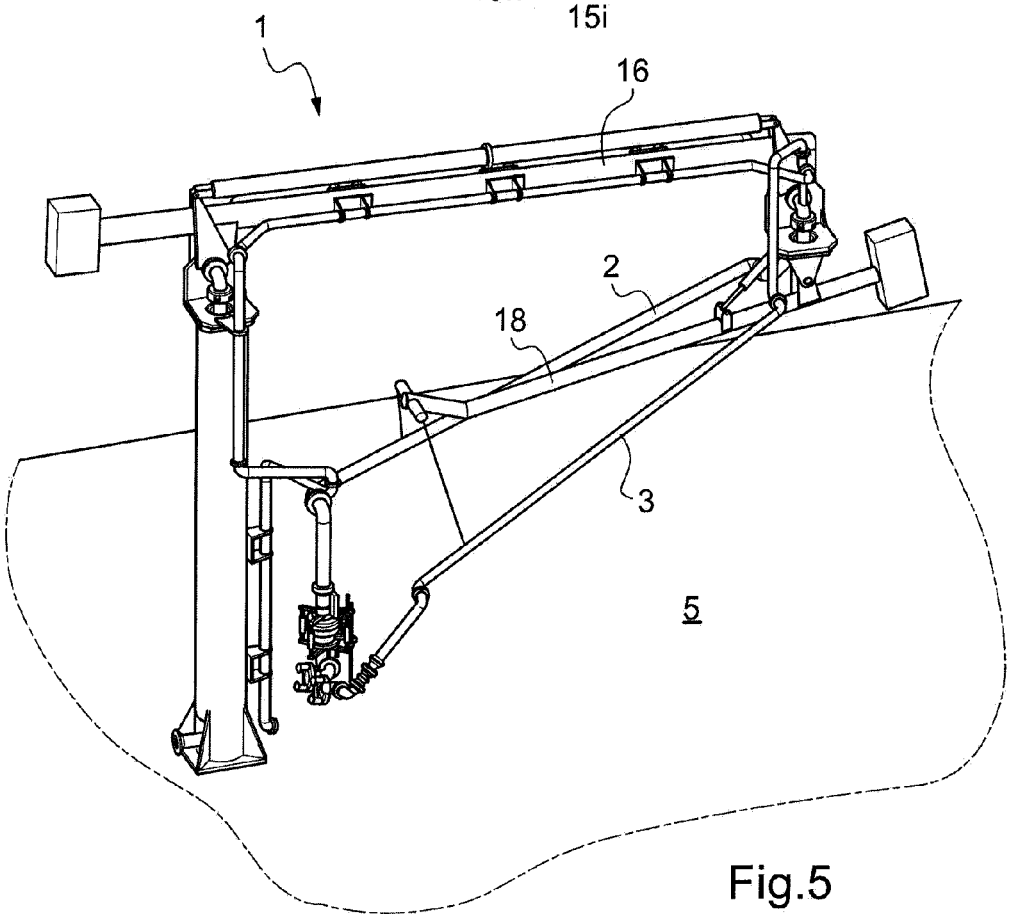
FIG. 5 is a schematic perspective view of the arm of FIGS. 1 and 2, in resting position.

In the embodiment represented in those Figures and which is given by way of non-limiting example only, the first pipe 2 is adapted for the transfer of liquefied natural gas (LNG) from a supply ship, of which the deck 5 is represented in FIG. 5, to another ship 6, such as a container ship.

The second pipe 3 is provided for the return to the supply ship of the gas vapors produced during the transfer.

Here they are pipes formed from several rigid sections joined to each other by fluid-tight articulations, adapted to be connected by one end 7, 8 to a fixed pipe leading to a tank (not shown) and terminating at their other end with a coupler 9, 10, here having a hydraulic motor, or any other device for connection/disconnection (coupling) of known type adapted to be connected to a target duct 11, 12 carried by the ship 6.

These couplers 9, 10 are of QCDC type (QCDC standing for "Quick Connect-Disconnect Coupler"), which is known per se, and an ERS 13, 14 (ERS standing for "Emergency Release System"), also known per se, is arranged upstream of the coupler 9, 10.

The fluid-tight articulations are, here, assemblies each of which is formed by the joining of at least one bend and at least one swivel joint, here cryogenic, and of Chiksan® swivel joint type.

As will be seen in more detail below, some of these assemblies form what is known in the technical field of these arms as "style 40's" and "style 50's", one defining a swivel joint or join the two ends of which are each welded onto a bend, and the other defining the joining of a first swivel joint, then a bend, then a second swivel joint forming an angle of 90° with the first joint, then a bend. Moreover, a "style 80" (for example at the end of the pipes 2, 3 provided with the couplers 9, 10) corresponds to a "style 50" complemented with a third joint parallel to the first joint and connected to the second by a bend.

The fluid-tight articulations are thus of cryogenic Chiksan® swivel joint type here but may be any type providing rotation around an axis of the two ends that are connected to it with transfer of the mechanical forces and providing the passage of the product internally and the necessary fluid-tightnesses.

In the case of the present embodiment, the articulated assemblies are 9 in number (referenced 15*a* to 15*i* in FIG. 3 for the product pipe 2) and are configured so as to give each of them six degrees of freedom: the three coordinates of translation as well as the angles of roll, pitch and yaw (Euler angles) or as a variant, their nautical equivalent.

Other lines, rigid or flexible, may furthermore be provided on this type of arm (electrical, for drying, for recirculation, etc.) but will not be described in more detail here since they are well-known to the person skilled in the art.

The support structure 4 for these pipes 2, 3 comprise an inner branch 16 mounted on a base 17.

In the present embodiment, the inner branch 16 is advantageously rotatably mounted on the base, around a horizontal axis 20 (see FIG. 3), in order to be able to raise and lower the arm. This articulation in a vertical plane is formed between a first end of that inner branch 16 provided with a counterweight 19 and a second end of that inner branch 16, from which the outer branch 18 is suspended from the inner branch 16.

The outer branch 18 is moreover suspended from the inner branch 16 by articulation means 22, described in more detail below, and which permit rotation of the outer branch around a vertical axis 23 and a horizontal axis 21. These articulation means 22 are arranged between a first end and a second end of the outer branch 18, the first end of that outer branch 18 being provided with a counterweight 24 for balancing the two parts of the outer branch 18 that are situated on opposite sides of the horizontal rotational axis 21 defined by those articulation means 22.

Figure 3:
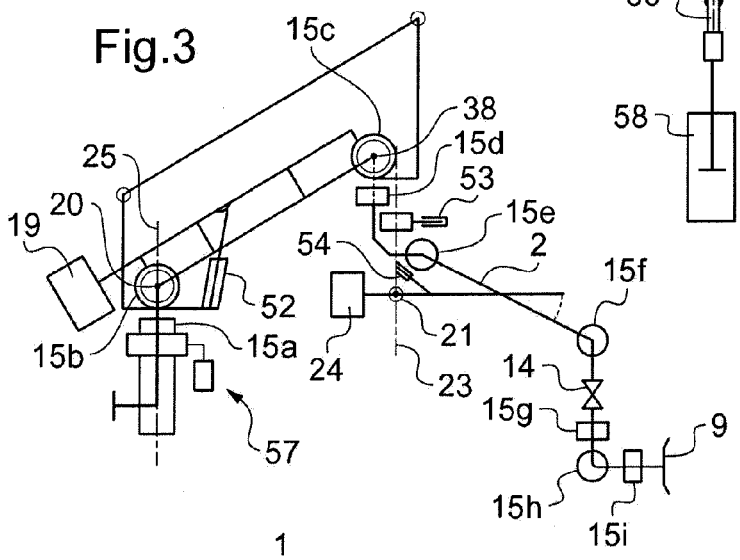
FIG. 3 represents a kinematic diagram of that arm, represented with a single main product pipe.

The inner branch is also advantageously rotatably mounted, in the case of the present embodiment, on the base 17, around a vertical axis 25 (see FIG. 3).

In order for the outer branch 18 to be able to follow the corresponding movements of that inner branch 16 in the vertical plane, the articulation means 22 enabling the suspension from the inner branch 16, are themselves articulated to that inner branch 16 around a horizontal axis 38 (see FIG. 3) extending parallel to the horizontal rotational axis 20 of the inner branch 16.

A device of rigid pantograph type 26, mounted on the inner branch 16, furthermore advantageously enables the rotational axis 23 of the outer branch 18 to be kept vertical, that is to say in practice, to keep it parallel to the vertical rotational axis 25 of the inner branch 16 in all circumstances.

In practice, the inner branch 16 is, here, mounted on the base 17 via a bracket-shaped support 27, with the interposition of a slewing ring 56, for the rotation of that inner branch 16 around the vertical axis 25. To enable the rotation around the horizontal axis 20, that inner branch 16 is, furthermore, provided with a mounting leg 28 articulated to the branch 29 of the bracket-shaped support 27, which extends vertically, with interposition of a slewing ring (not visible in the drawings).

In similar manner, the articulation means 22 also comprise a support having the form of a bracket-shaped part 30, on one of the branches of which (the one, 31, extending horizontally) is articulated a clevis articulation 32 defining the horizontal rotational axis 21 enabling the articulation of the outer branch 18 in a vertical plane.

This clevis articulation 32 comprises, more specifically, two forks 33 and 34 accommodated within each other and joined by an articulation shaft 35 defining said horizontal axis 21.

Figure 1:
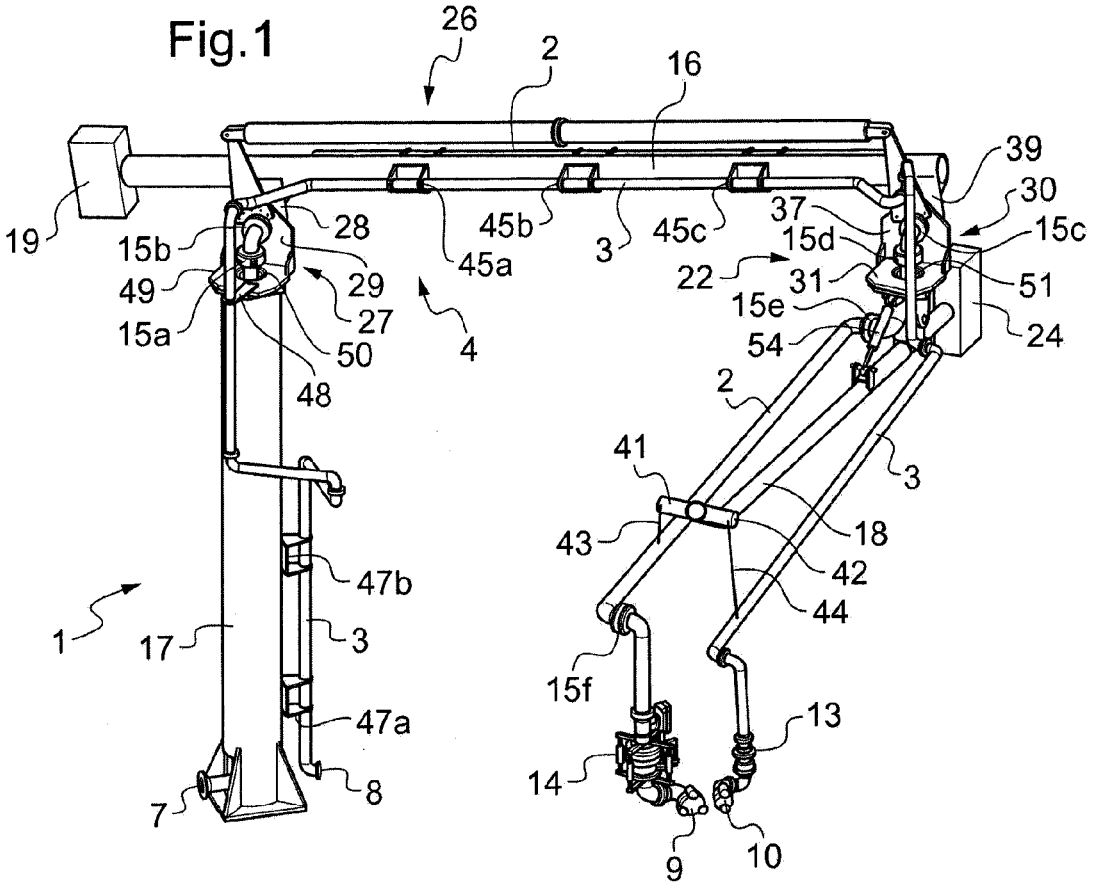
FIG. 1 is a schematic perspective view of a transfer arm according to the invention.
Figure 2:
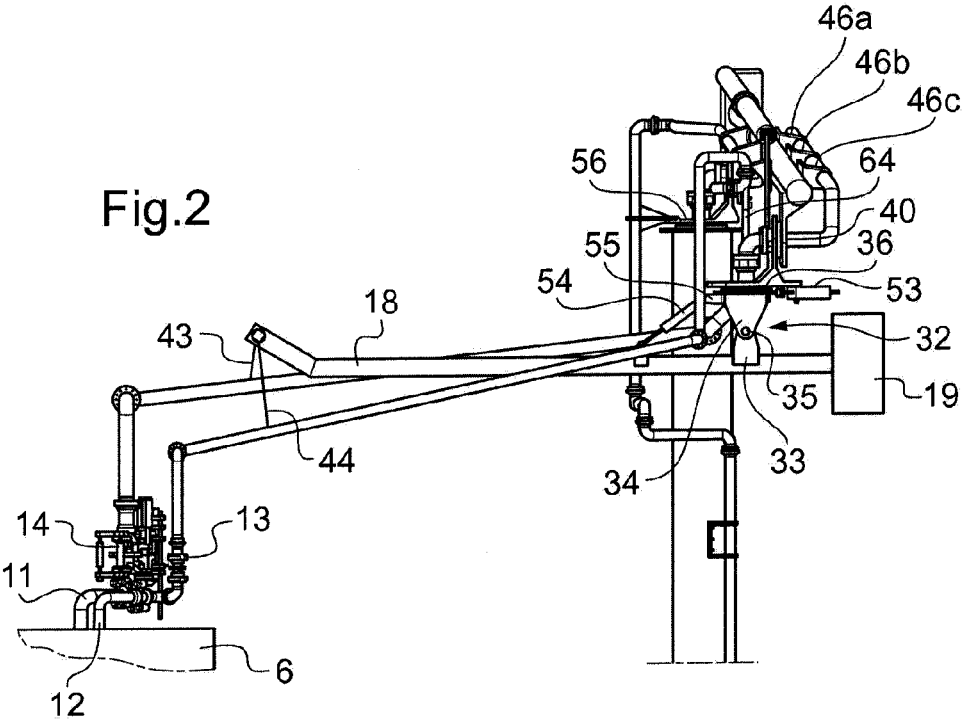
FIG. 2 is a partial view in side elevation of that arm, in connection position.

This clevis articulation 32 is, itself, rotatably mounted on the bracket-shaped part 30, around the vertical rotational axis 23 enabling articulation of the outer branch 18 in a horizontal plane, here also via a slewing ring 36 (see FIG. 2).

The branch 37 of the bracket-shaped part 30, which extends vertically, is, respectively, rotatably mounted, around the horizontal rotational axis 38 (see FIG. 3), via a suspension leg 39, fastened to the second end of the inner branch 16, and a slewing ring 40.

The outer branch 18 has, in a T-shaped general configuration, two lateral ends 41, 42, to each of which is fastened the end of a flexible link, here a cable 43, 44.

These lateral ends 41, 42 are formed at the opposite end of the outer branch 18 to that bearing the counterweight 24 and on a part of that outer branch 18 forming an angle with the rest of the branch, so as to be oriented upwardly when the latter is suspended from the inner branch 16.

The other end of each of these cables 43, 44 is respectively fastened to the product pipe 2 and to the vapor return pipe 3, thus suspending them with flexibility to the outer branch 18, upstream of the couplers 9, 10.

Going towards the opposite end, the rest of each of those pipes passes in part alongside the inner branch 16, to which each of them is fastened by U-shaped brackets (referenced 45*a* to 45*c* for the vapor return pipe 3 and 46*a* to 46*c* for the product pipe), then the base 17, to the outside of which the vapor return pipe 3 is fastened by two other U-shaped brackets 47*a*, 47*b*, whereas the product pipe extends within that base 17, concentrically thereto.

The vapor return pipe 3 is, moreover, fastened by a lug 48 to the branch 49 of the bracket-shaped support 27, which extends horizontally.

It is also to be noted that pipe 2 moreover passes through the articulation supports 27 and 30 as well as the legs 28 and 39, thanks to passage openings, here circular, formed therein. Those visible in the drawings bear the numerical references 50 and 51. It is also to be noted that at the location of those passages by the articulation supports 27 and 30, the fluid-tight articulations form "style 50's" whereas the vapor return pipe 3 is provided with articulations of "style 40" type and sections configured so as to enable it to pass around those articulation supports 27 and 30.

As can better be seen in FIG. 2, the two lines 2 and 3 are separate, the vertical axis swivel joint 15*d* is linked (at 64) to the pipe 2 and to the pipe 3 at a vertical axis swivel joint, also aligned on the same vertical axis such that the two lines can pivot separately on the same vertical axis as well as the outer branch 18.

Actuating means for the different inclinations and orientations are moreover provided.

More particularly, jacks 52, 53 and 54, here hydraulic, make it possible to actuate, respectively, the inclination of the inner branch 16, the orientation of the outer branch 18 in the horizontal plane and the inclination of the latter in the vertical plane.

It is to be noted, in this connection, that the jacks 53 and 54 are articulated to a plate 55 joined to the clevis articulation 32 and interposed between that articulation and the slewing ring serving for its mounting on the articulation support 30, the slewing ring 36 itself being fastened to that plate 55.

The jacks 53, 54 for inclination and orientation of the outer branch 18 are disengageable, so as to be able to be disengaged or set to "coast" once the pipes 2 and 3 have been connected to the target ducts 11 and 12, whereas the other actuating means remain locked in that position.

Figure 4:
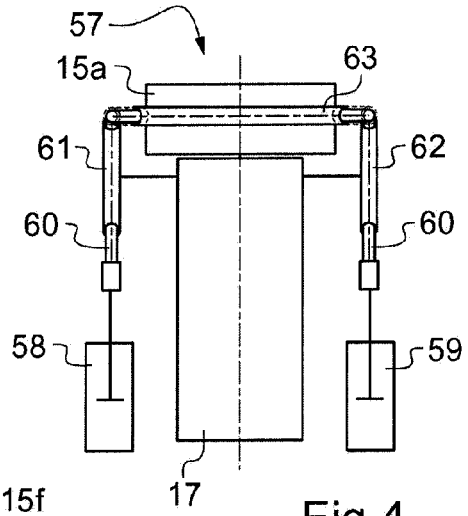
FIG. 4 represents an operating diagram of the actuating device for orienting the arm.

FIG. 4 very diagrammatically represents the actuating device or actuator 57 of the orientation of the inner arm 16 on the base 17. This is a specific actuator enabling fairly large travel.

To that end, it comprises two jacks 58, 59, each acting on the end of a cable 60.

After its fastening point to each of the jacks 58, 59, the cable first of all passes over a redirecting pulley 61, 62, arranged vertically and fastened to the base tube 17, then over a horizontal pulley 63 arranged horizontally and concentrically to the vertical axis swivel joint 15*a* to which it is also fastened.

It will be noted that the actuators 52 and 57 have only been represented in FIGS. 3 and 4, in the interest of clarity for the other Figures.

The operation of the set of actuators 52, 53, 54 and 57 is of course coordinated by a hydraulic circuit and an electrical circuit (not shown), controlled manually or automatically corrected with a slave control circuit of any appropriate type known per se.

The connection kinematics of such a loading arm 1 is as follows: the transfer arm 1 is first of all extended from a resting position represented in FIG. 5, in which the outer branch 18 extends approximately parallel to the inner branch 16, beneath it.

Figure 6A:
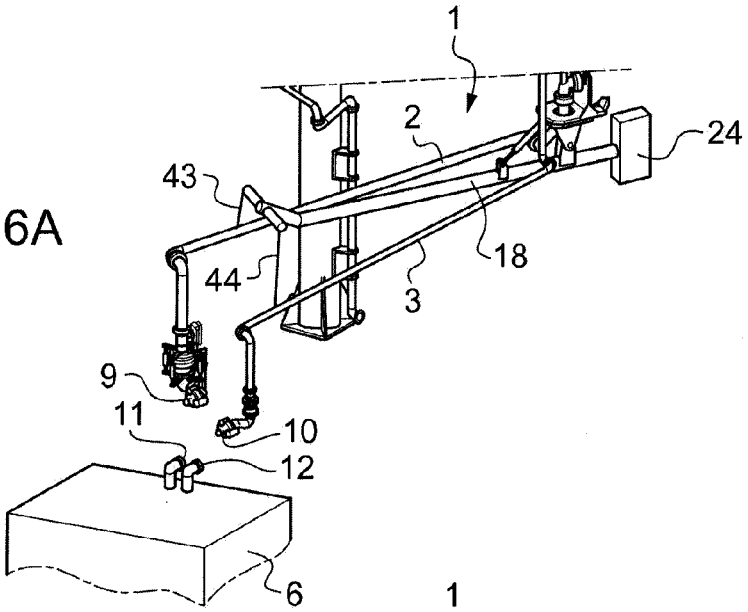
FIGS. 6A through 6C represent the connection kinematics of that arm, the latter being represented only partially.

An approach phase is then commenced (FIG. 6A), during which both the inner branch 16 and the outer branch 18 may be maneuvered in terms of orientation and/or inclination in order to bring the couplers 9 and 10 into the vicinity of their respective target duct 11 and 12 of the ship 6.

Figure 6B:
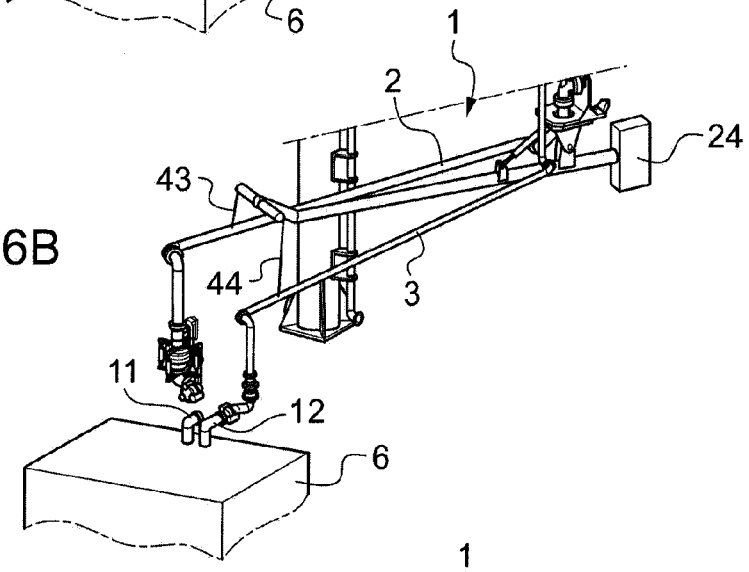

Next, in a first phase (see FIG. 6B), the vapor return pipe 3 (lighter) is joined to its target duct 12.

Figure 6C:
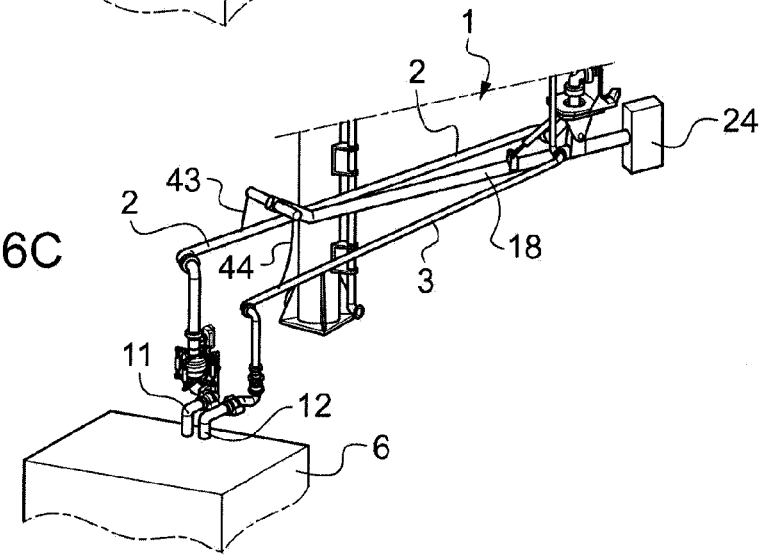

In a second phase (see FIG. 6C), the product pipe 2 is connected to its target duct 11. In the connection position, the outer branch 18 extends in a plane forming an angle with the plane in which extends the inner branch 16, in practice less than or equal to 90° (here slightly less than 90°).

Once the two pipes 2, 3 have been connected, the actuators 52 and 57 are locked whereas the actuators 53 and 54 coast in order to follow the movements of the ship 6 as best possible.

As can be seen in these Figures, the flexible links 43 and 44 give a certain degree of flexibility between the two pipes 2, 3, enabling not only a connection in two phases thereof, but also optimized following of the movements of the two ships 5 and 6.

More generally, such a transfer arm 1 has the following particularities and advantages:

- Arrangement composed of 3 main members and 9 articulations enabling:
  - Compass type opening in the vertical plane;
  - Compass type opening in the horizontal plane;
  - which makes it possible to cover a large set of connections both in the vertical plane and the horizontal plane while maintaining all the degrees of freedom to allow the 6 degrees of movement at the connection.
- Arrangement composed of a balanced articulated main member (inner branch) and of a balanced articulated assembly comprising one or two pipes for fluid enabling:
  - The connection to a duct or two ducts situated in the upper part of a ship deck or within a ship, accessible in that case through an opening in the flank of the ship;
  - the limitation of the forces on the ducts for connection with the internal main member of which the movement is arrested after connection and the assembly having a coasting articulation to follow the relative movements;
  - independence of the two connected pipes, in order to follow the relative movements between arm and connections due to the movements of the ship or ships, in accordance with the 6 degrees of freedom.
- Arrangement of the articulated assembly with a single balancing member for two articulated pipes which enables their independent connection so as to accommodate connections with differences in relative positions.
- Arrangement of the articulated assembly with a single balancing member for two articulated pipes which enables the emergency release to be carried out with raising of the two pipes via the maneuvering jack on that balancing member and the raising of the articulated main member (inner branch).

Assembly enabling the above-described functionalities to be provided through 270° of rotation around its base.

The present invention is not limited to the preferred embodiment described above by way of non-limiting example and illustrated in the drawings. It concerns the variant embodiments within the capability of the person skilled in the art.

In particular, the hydraulic jacks may be replaced by pneumatic or electrical jacks, or motors, such as rotary motors.

The remote part of the pipes beyond the inner member may also be formed from flexible pipe the aim of which would be to enable a connection situated further away from the freeboard of the ship to load and which would potentially eliminate the last vertical and horizontal swivel joints.

More generally, such a transfer arm 1 may be used in an application for transfer of petroleum or chemical products, liquefied petroleum gas (or LPG), liquefied natural gas (LNG) with or without any vapor return pipe and one or more product pipes.

The invention claimed is:

1. A transfer arm for a fluid product, comprising:

at least one transfer pipe comprising several sections linked to each other by fluid-tight articulations, and an end provided with a connect-disconnect device adapted for connection of the pipe to a target duct;

a support structure for at least one transfer pipe, the support structure comprising an inner branch which is mounted on a base and an outer branch which is suspended from the inner branch by articulation means enabling rotation of the outer branch around a first vertical axis and a first horizontal axis, the transfer pipe including an inner portion which is supported by the inner branch and an outer portion which is supported by the outer branch, said outer branch comprising an end which is equipped with a balancing counterweight for balancing said outer branch and the outer portion of the transfer pipe around the first horizontal axis; and disengageable first actuating means for actuating the rotations of the outer branch around the horizontal axis and the vertical axis;

wherein the outer portion of the transfer pipe is suspended from the outer branch by a flexible link which is connected between the outer branch and the transfer pipe upstream of the connect-disconnect device.

2. The arm according to claim 1, further comprising a second transfer pipe which includes several sections linked by fluid-tight articulations, and an end provided with a second connect-disconnect device adapted for connection of said second pipe to a second target duct, the second transfer pipe comprising an outer portion which is suspended from the outer branch by a second flexible link which is connected between the outer branch and the second transfer pipe upstream of the second connect-disconnect device.

3. The arm according to claim 2, wherein and end of the outer branch has a T-shaped configuration comprising two lateral ends to which the flexible links are connected.

4. The arm according to claim 1, wherein the link comprises one from the group consisting of a cable, a chain or a rope.

5. The arm according to claim 1, wherein the inner branch is rotatably mounted on the base around a second horizontal axis located between a first end of the inner branch which is provided with a counterweight and a second end of the inner branch from which the outer branch is suspended, and wherein the outer branch is connected to the inner branch by means enabling the outer branch to rotate relative to the inner branch around a third horizontal axis.

6. The arm according to claim 5, further comprising a pantograph device mounted on the inner branch for keeping the first vertical axis of the outer branch vertical.

7. The arm according to claim 5, wherein the inner branch is rotatably mounted on the base around a second vertical axis.

8. The arm according to claim 7, further comprising second actuating means for rotating the inner branch about the second horizontal axis and the second vertical axis.

9. The arm according to claim 1, wherein the articulation means comprise a clevis articulation which defines the first horizontal axis and which is rotatably mounted, via a slewing ring on a support, for rotation about the first vertical axis.

10. The arm according to claim 9, wherein the support comprises a first branch to which the clevis articulation is mounted.

11. The arm according to claim 10, wherein the support comprises a second branch which is rotatably connected via a second slewing ring to the inner branch for rotation about said first horizontal axis.

12. The arm according to claim 1, wherein the inner branch is mounted on the base via a bracket-shaped support.

13. The arm according to claim 1, wherein the first actuating means comprise at least one of a jack or a motor.

14. The arm according to claim 8, wherein the second actuating means comprises a number of jacks which are operatively engaged with the inner branch via a cable and a set of pulleys.

15. The arm according to claim 1, wherein each of the fluid-tight articulations comprises at least one bend and at least one swivel joint, and wherein the fluid-tight articulations are configured with the sections of the transfer pipe so as to give the transfer pipe six degrees of freedom.

16. The arm according to claim 2, wherein the first and second transfer pipes are adapted for transferring the same or different products and are configured to be connected independently to their respective first and second connect-disconnect devices.

17. The arm according to claim 1, wherein an end part of the transfer pipe is produced from flexible pipe.

* * * * *